US005253932A

United States Patent [19]

Nesovic

[11] Patent Number: 5,253,932

[45] Date of Patent: Oct. 19, 1993

[54] MODULAR COUNTERTOP SYSTEM

[76] Inventor: Danilo N. Nesovic, 6370 Kimi La., La Mesa, Calif. 91942

[21] Appl. No.: 803,013

[22] Filed: Dec. 5, 1991

[51] Int. Cl.[5] ..... A47B 96/18

[52] U.S. Cl. ..... 312/140.3; 108/27; 52/829

[58] Field of Search ..... 312/140.1, 140.3; 108/27, 90; 211/153, 183; 52/783, 784, 829, 830, 821

[56] References Cited

U.S. PATENT DOCUMENTS

| | | | |
|---|---|---|---|
| 1,396,554 | 11/1921 | Breese | 108/27 |
| 2,594,516 | 4/1952 | Swisher | 312/140.3 X |
| 2,665,183 | 1/1954 | Battles | 312/140.3 X |
| 3,606,508 | 9/1971 | Burnes . | |
| 4,996,817 | 3/1991 | Nelson | 52/783 |

FOREIGN PATENT DOCUMENTS

| | | | |
|---|---|---|---|
| 3323438 | 1/1985 | Fed. Rep. of Germany | 312/140.3 |

OTHER PUBLICATIONS

Solidex Brochure "Join the Counter Revolution" (date unknown).

Forms & Surfaces Brochure "Neoparium ® 15" (1989).

American Olean Tile Brochure "Ceramic Tile Trim" (1988).

duPont booklet E-68853 "Professional Installer's Guide" (1984).

*Primary Examiner*—Kenneth J. Dorner

*Assistant Examiner*—Brian K. Green

*Attorney, Agent, or Firm*—Brown, Martin, Haller & McClain

[57] ABSTRACT

A modular countertop structure is described. It is supported by an underlying base and has a flat unedged surface-providing sheet supported by the base and having an edge including a peripheral recess, a preformed elongated edge facing with a rearward extending tongue which fits into the recess, and adhesive for directly bonding the sheet to the edge facing through their adjacent surfaces in the recess. The countertop sheet and the edge facing are made of materials which are impervious to moisture penetration, impact and scratching, including natural stone, synthetic stone-like material, ceramic, concrete, glass-like sheets, agglomerated stone, cement materials, metal or terrazzo. They may be made of the same or contrasting materials, so that the edge facing and the countertop present appearances which are the same or consistent with each other. In some embodiments, an underlying substrate will also be used to support the countertop sheets. The modular countertop structure or system of this invention has numerous advantages over the prior systems, such as ceramic tile systems. Components of the present system can be pre-fabricated by mass production methods for delivery and simple assembly at the job site and can be manufactured using automated procedures and specialized machinery, thus eliminating the need for the current hand grinding and shaping used to finish such materials, thus reducing the costs of manufacture and installation and insuring uniform fit and finish of the countertops.

20 Claims, 3 Drawing Sheets

MODULAR COUNTERTOP SYSTEM

BACKGROUND OF THE INVENTION

1. Field of the Invention

The invention relates to countertops of the type commonly used in residential, commercial, industrial and institutional settings for use as kitchen, bathroom or office work surfaces, desk tops and furniture tops.

2. Description of the Prior Art

Blocks or sheets of natural stone such as marble or granite, or synthetic stone-like materials such the commercial material sold under the trademark "Corian" make excellent countertop and work surfaces and, consequently, are in high demand. However, it is currently necessary to use specially trained craftsmen and expensive equipment to fabricate and install these types of commercial natural and manmade stone-like surfaces. The synthetic materials can be fabricated initially in generally standardized shapes and sizes, but the natural stone materials normally require extensive shaping, cutting and finishing to form suitable surfaces. However, both require extensive and specialized hand work to form appearance edges on each individual piece. It is common in the industry for specialists in these types of materials to need to obtain special certification for fabrication and installation, in order to insure that warranty specifications for finished construction can be met.

Similarly, there are a number of other materials which make excellent countertops, but which also have been little used since their fabrication and/or installation have involved expensive and difficult procedures, or (as in the case of metal sheets) have heretofore produced only unattractive, institutional or commercial appearances. In addition to metal sheets, these include large ceramic slabs, cement slabs, glass-like sheets, sheets of agglomerated stone, cement materials, terrazzo and the like.

Consequently, the vast majority of countertop installations in residential and commercial settings are made of other types of materials, all of which have individual deficiencies and disadvantages.

Ceramic tile is a very common surfacing material, but requires extensive labor and time for installation since a mortar base must first be prepared. Further, because of the nature of the formation process, ceramic tiles cannot be made flat and smooth; all tiles have surface irregularities. Consequently, tile is available only in very small sizes and yields creates work surfaces which are quite irregular and have an extensive joint system which requires grouting to fill the joint spaces. Not only do these joints detract from the appearance, but they contribute to the unevenness of the surface and must frequently be cleaned and re-grouted, particularly where foods, medicines, chemicals and similar materials are handled or prepared.

Plastic laminate countertops are also common. Because the plastics are relatively soft materials, however, the plastic laminate counters are easily cut, gouged or otherwise damaged during normal service. In addition, they can be stained, dissolved or roughened by various chemicals and liquids that may be placed or spilled on them.

Wood countertops are sometimes used, but wood is a relatively non-uniform material, tends to dry out and crack or split or, in the case of plywood, delaminate. The wood must also be frequently resealed to prevent liquid penetration. Further, as with the plastic laminate counters, the wood surfaces are relatively soft and are easily cut, gouged or otherwise abraded.

It would therefore be advantageous to have a practical countertop system which would: be able to use the desirable properties of materials such as natural stone, synthetic stone-like materials, ceramics and the like in preformed modular slab or block form; allow production of large, flat work surfaces which are water, impact and scratch resistant; produce countertops which provide a uniform or consistent appearance not only across the top surface but also along all edges; make the materials available in wide geographical areas and at relatively low cost; and which could be rapidly and easily constructed by journeyman installers. Heretofore no countertop system has been available which accomplishes these desirable objects.

SUMMARY OF THE INVENTION

In summary, the modular countertop structure of the present invention is underlain by a base and has a flat unedged surface-providing sheet supported by the base and having an edge including a peripheral recess, a preformed elongated edge facing with a rearward extending tongue which fits into the recess, and adhesive for directly bonding the sheet to the edge facing through their adjacent surfaces in the recess. The countertop sheet and the edge facing are made of materials which are impervious to moisture penetration, impact and scratching, including natural stone, synthetic stone-like material, ceramic, concrete, glass-like sheets, agglomerated stone, cement materials, metal or terrazzo.

More specifically, the modular counter structure of the present invention is supported by an underlying base and comprises at least one flat unedged surface-providing sheet member formed of a first material which is essentially impervious to moisture penetration, impact and scratching; the member having a top, a bottom and a peripheral edge area; the bottom facing and being supported by the base; and with the edge area comprising at least one surface of a peripheral recess around and facing outwardly from at least a portion of the sheet member; at least one preformed elongated edge facing member formed of a second material which is also essentially impervious to moisture penetration, impact and scratching; the edge facing member having a front and a back; the back comprising a rearward extending tongue portion adapted to fit into the recess; the front of the edge facing member presenting an appearance which is substantially the same as or consistent with the appearance of the top surface of the sheet member; and adhesive for directly bonding the sheet member to the edge facing member, at least in part through the adjacent surfaces of the tongue portion and the edge area in the recess. The countertop surface forming member may be made of natural stone, synthetic stone-like material, ceramic, concrete, glass-like sheets, agglomerated stone, cement materials, metal or terrazzo. The corners of the countertop may be squared off or rounded, and the front of the edge-forming members may be profiled.

The modular countertop structure or system of this invention has numerous advantages over the prior systems, such as ceramic tile systems. For instance, it does not require the use of specially trained fabricators or workers or the use of expensive and sophisticated equipment for installation, nor does it require extensive fabrication of edge profiles or surfaces.

Further, the present system allows use of materials at substantially reduced costs, as compared to current systems such as granite or "Corian TM" installations, since the components of the present system can be prefabricated by mass production methods for delivery and simple assembly at the job site. The components of the system can also be available in a wide variety of sizes, materials and colors to allow rapid and convenient installation of many different countertops for residential, commercial, industrial or institutional facilities.

The system also lends itself easily to provision of large warehoused inventories of the modular components by manufacturers or distributors, so that any particular combination of components called for in an architect's or designer's countertop plans can be readily shipped to the job site.

Finally, the components of this system can be manufactured using automated procedures and specialized machinery, thus eliminating the need for the current hand grinding and shaping used to finish such materials, thus reducing the costs of manufacture and installation and insuring uniform fit and finish of the countertops.

DETAILED DESCRIPTION AND PREFERRED EMBODIMENTS

Figure 1:
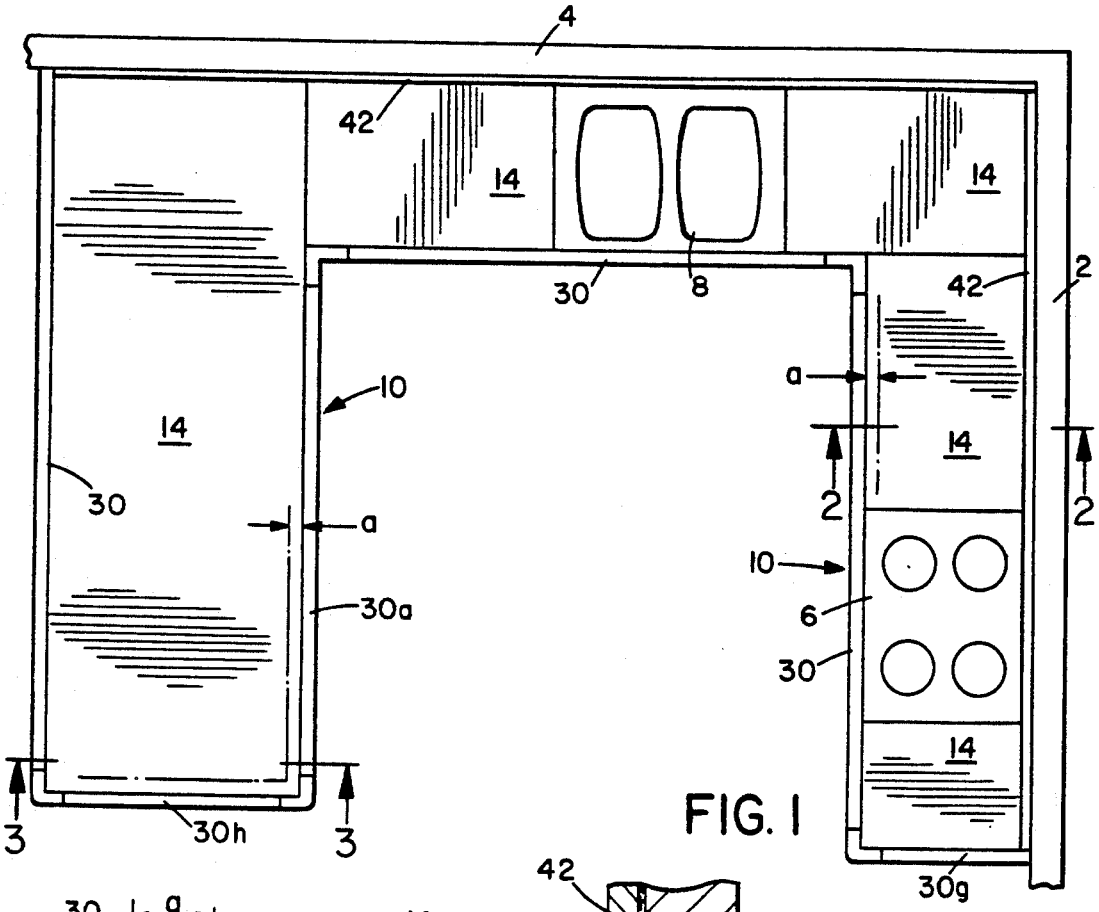
FIG. 1 is a top plan view of a typical kitchen counter arrangement.

The invention herein is best understood by reference to the Figures of the drawings. FIG. 1 shows a plan view of a typical kitchen countertop work area layout. Two enclosing walls of the area are shown at 2 and 4. A kitchen range 6 and kitchen sink 8 are located in typical relationship. The view shown is of a residential kitchen. However, the description herein will also apply to a commercial kitchen, or even an industrial or institutional kitchen, with the principal difference being that the overall area of the kitchen would be greater and the range and sink appliances would be multiplied one or more times to provide the desired food service capacity for the commercial, industrial or institutional kitchen. If will also be understood that equivalent countertop structures and systems will be useful for work surfaces in laboratories, offices, industrial facilities, medical facilities, rest rooms and many other locations, and that the systems herein are not to be limited merely to kitchen locations.

Figure 2A:
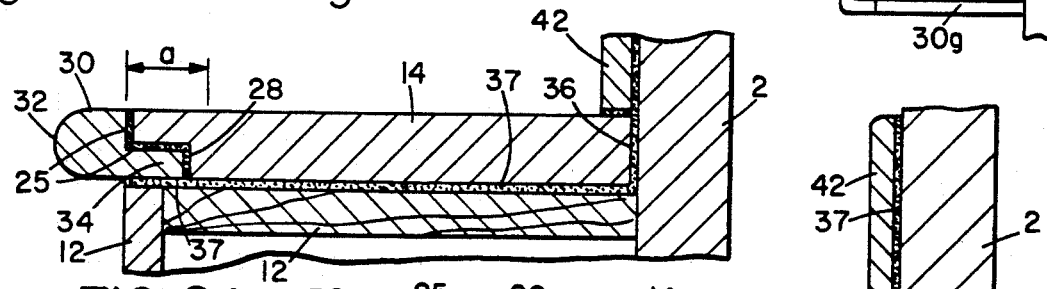
FIG. 2A is an enlarged sectional view taken on line 2—2 of FIG. 1 of a typical wall-abutting counter structure.
Figure 2B:
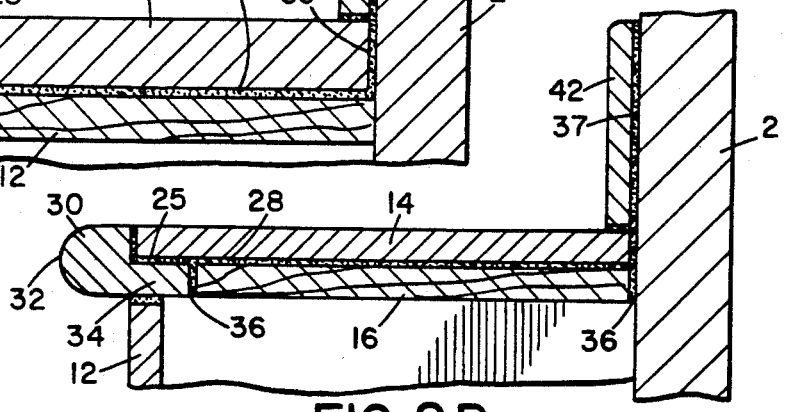
FIG. 2B is an enlarged sectional view similar to that of FIG. 2A, but including a substrate.
Figure 3:
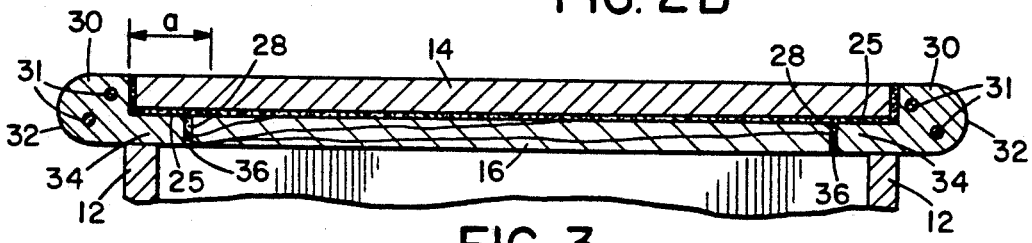
FIG. 3 is an enlarged sectional view taken on line 3—3 of FIG. 1 of a typical free-standing counter structure.

Adjacent to the range 6 and sink 8 is the counter area generally designated 10. The counters are normally formed of a base 12 which may abut the wall 2 or 4 as shown in FIGS. 2A and 2B or which may be freestanding as shown in FIG. 3. Typically the base 12 is formed from various types of cabinets, storage bins, shelving, drawer stacks or the like, although the supporting base 12 may also be simply table legs or a table frame. The height of the base 12 will normally be such that the addition of the countertop system of this invention will place the countertop work surface at the desired height for the work surface. The actual level of the work surface will vary in accordance with well known ergonomic factors, such as whether the users will be seated or standing when utilizing the countertop, whether work pieces placed on the countertop will themselves have substantial height and the like. Commonly such countertop levels are approximately 28–36 inches (70–90 cm) above the underlying floor surface. Since the thickness or depth of the countertops of the present invention will vary as described below, the height of the base 12 will also vary such that the sum of the base height and the countertop thickness will equal the desired work surface level.

The countertop system of the present invention is comprised of two principal elements: a flat unedged surface-providing sheet member and a front edge facing member. Each of these will be separately described below.

The purpose of the present system is to be able to provide a means of incorporating materials which have heretofore been difficult to use for countertops due to fabrication and installation limitations. In the present system all solid materials which exhibit the properties of being substantially impervious to moisture and resistant to impact and scratching, including but not limited to natural stone or synthetic stone-like materials, large ceramic slabs, concrete and cement materials, glass-like sheets, sheets of agglomerated stone or metal and materials such as terrazzo and the like, can be utilized as the materials forming the countertops 14 and the facings 30. For the purposes of this invention, "synthetic stone-like materials" having the properties of moisture imperviousness and impact and scratch resistance will include products such as "Corian TM", polymeric materials such as engineering plastics and composite materials formed of a core faced on all sides with veneer. Also, "imperviousness" and "resistance" means that under normal usage, the materials of this system are not affected by moisture, impact or abrasion. (The material forming the countertop and facing will hereinafter be exemplified as natural stone, specifically granite, for brevity, but it will be understood that the discussions below are generally applicable to all of the materials described.)

Figure 8:
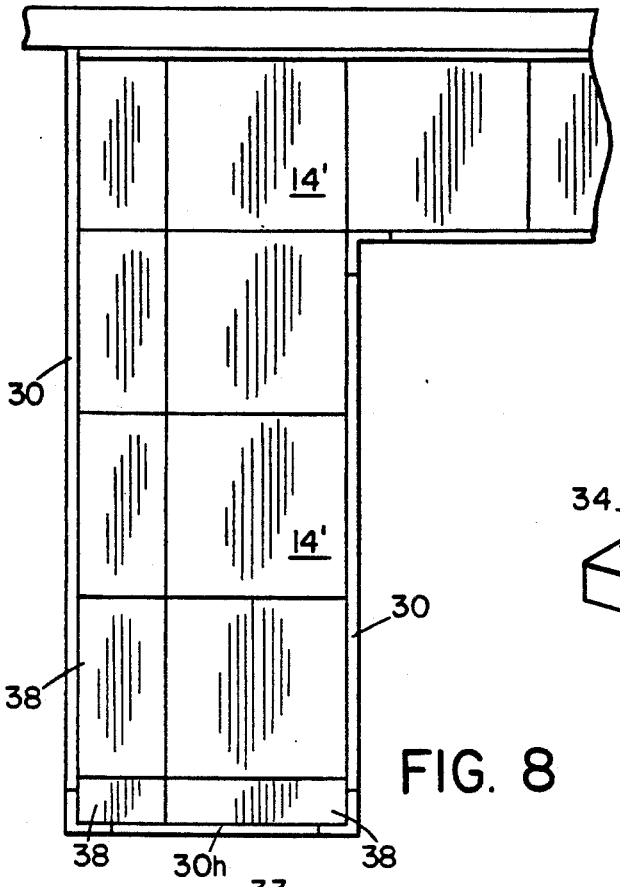
FIG. 8 is a top plan view of a counter portion using standard sized panels.
Figure 9:
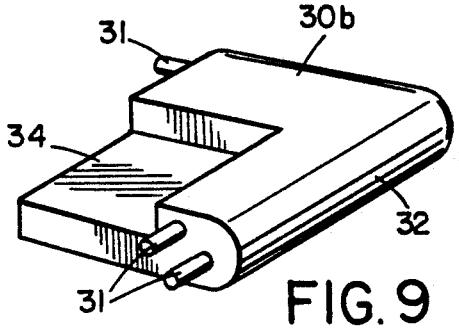
FIG. 9 is a pictorial view of one type of outside corner facing.
Figure 11:
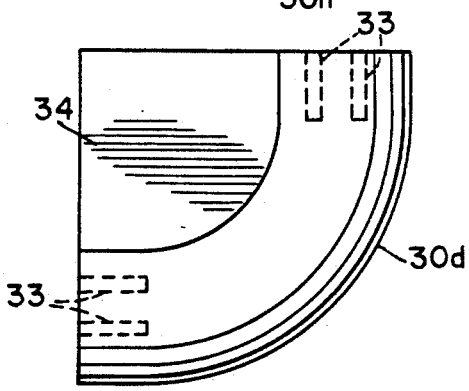
FIG. 11 is a top plan view of a rounded type of outside corner facing.
Figure 10:
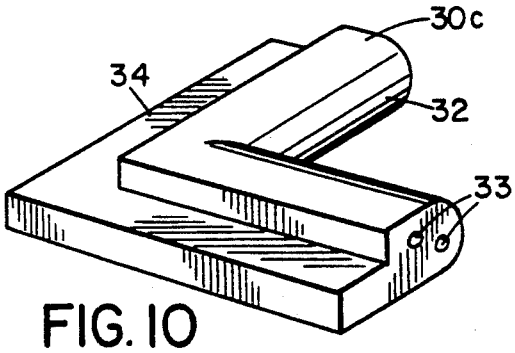
FIG. 10 is a pictorial view of one type of inside corner facing.

For the countertops 14, one can obtain the sheet materials commercially in many dimensions. It is preferred to use pieces having minimum dimensions of 24×24 inches (60×60 cm), as shown at 14' in FIG. 8, although larger dimensions are preferred to minimize the number of joints in a work surface. Of course, these pieces may be cut where necessary to provide fillets as at 40 or to fill out a countertop area as at 37 or 38.

Granite pieces are commonly of ¼–¾ inch (6–18 mm) in thickness, but thinner and thicker pieces may also be used. Generally thinner pieces are to be avoided, however, because they are more difficult to handle and are more easily cracked, or in the case of metal, bent or creased. Also, with certain types of substrates, to be described below, the thin pieces may not have adequate support in the present invention to prevent sagging and cracking when in use. Thicker pieces, which may be ¾–2 inches (18–50 mm), are normally used where, as illustrated in FIG. 2A, it is desired to dispense with a substrate and support the countertop 14 directly on the top of the base 12. Of course, where desired thicker pieces can be used with a substrate, but they will not substantially increase the strength of the countertop as compared to those pieces having the desired ¼–¾ inch (6–18 mm) range.

Also part of the current invention is the modular front edge facing strip or nosing 30. This edging or nosing 30 will be in the form of elongated strips of lengths of a few inches or centimeters up to 8–12 feet (2.4–3.6 m) or more and will be formed of the same type of material as the countertops 14. Critical to the present invention is that, as will be described below, the edge facing strips 30 are adhered directly to the countertop pieces 14. This imparts to the entire work surface the property of moisture imperviousness, since moisture cannot penetrate into the individual countertop or edge facing pieces or, when the pieces are directly adhered together, into the joints between the pieces. Further, because of the smooth surfaces of the pieces and simple removal of any adhesive which exudes from the joints during installation, the entire work surface can be made smooth and level. These features of the present system are entirely unlike, and markedly superior to, current ceramic tile installations. In tile installations, the tiles are not directly adhered to each other but are merely placed in spaced-apart positions in a mortar layer and the intervening joints filled with a simple grout, which often becomes chipped and dislodged from the joints, leaving the joints susceptible to moisture infiltration. Further, as noted above, tile surfaces are necessarily irregular. It is not possible to make commercially acceptable ceramic tiles larger than about 12×12 inches (30×30 cm), since the formation process for ceramic tile causes irregularities in the tiles, and these types of irregularities increase dramatically as one tries to produce tiles of larger dimensions.

The strips will be formed in various straight lengths as illustrated for instance at **30*a* in the various Figures. Other members in the modular system will be of shorter length but will form squared or curved corner or end pieces as illustrated at 30*b* (an outside squared corner), 30*c* (an inside squared corner), 30*d* (an outside radius corner) and 30*e* (an inside radius corner). The straight lengths of the nosing or edging 30 can also be cut into short lengths where needed, as indicated at 30*f*, 30*g* and 30*h***.

The individual abutting sections of the edging may, if desired, be aligned by dowels or pins 31, normally of wood or preferably plastic, secured in holes 33 in the ends of each section of edging 30.

Figure 5A:
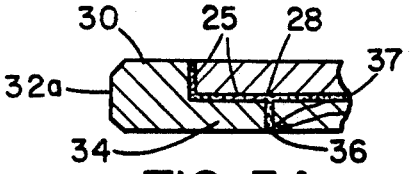
FIGS. 5A–5C are sectional views similar to a portion of FIG. 2A, illustrating typical front profiles and tongue-and-recess configurations.
Figure 5B:
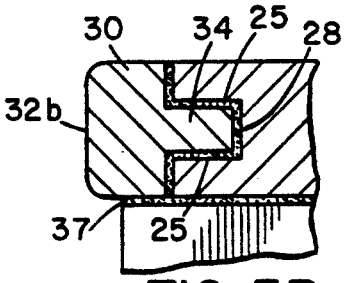
Figure 5C:
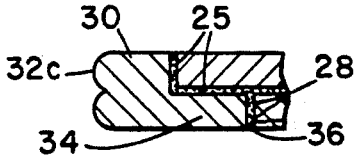

The cross section of the facing strip 30 has at the front thereof a nose portion 32 which is visible to the observer and which consequently will be profiled to an attractive surface appearance. Generally the outward facing nosing 32 may have any of a variety of different appearances as desired by the counter designer. In a common configuration, the nosing 32 will simply be rounded as shown for example in FIGS. 2, 3, 9 and 10. However, a variety of alternative shapes can be used, three examples of which are shown in FIGS. 5A, 5B and 5C, being respectively a flat beveled nosing **32*a*, a flat nosing 32*b* with rounded corners and a profiled nosing 32*c***.

Figure 4:
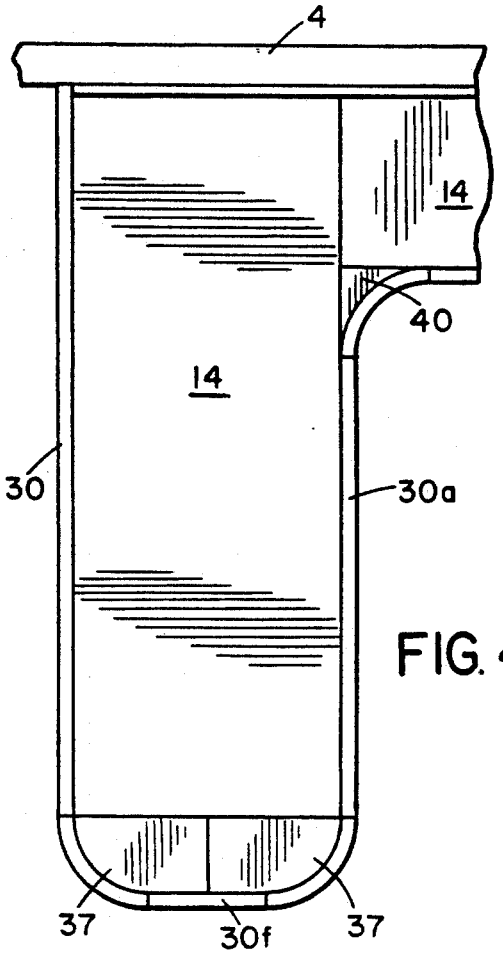
FIG. 4 is a top plan view of a counter portion with rounded corners.
Figure 12:
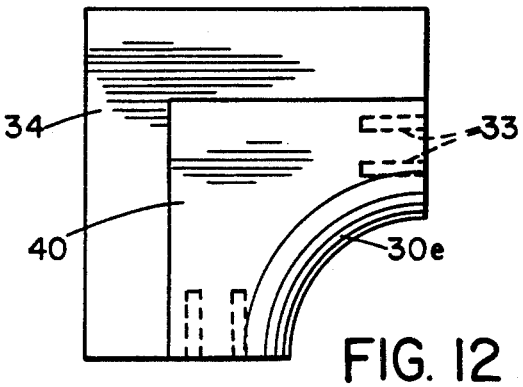
FIG. 12 is a top plan view of a rounded inside corner facing, also incorporating an integral fillet.

Depending on the appearance of the counter system desired, the edge facing strips 30 will be of the same or a different material from the material of the countertops 14. For instance, if the same granite material is used for both the countertops 14 and the edge facing strips 30, the entire structure will present a uniform and massive appearance. Alternatively, for instance, a lighter color granite may be used for one component and a darker color granite for the other, so that the appearance will be of a work surface of one color edged with a facing of a contrasting or complementing color. Separate sections of the overall structure may be formed in different materials or different colors of materials (as, for instance, in FIG. 1 the portion near the range 6 may contract with the free-standing portion opposite).

Where rounded end portions or corner portions are used in the system as illustrated for instance in FIG. 4, it will be necessary to incorporate fillets 40 into the system to finish the overall countertop. These will normally be specially cut pieces of the same material used for the countertop 14. However, if the facing strips 30 are of the same material as the countertops 14, the fillet 40 can be incorporated directly into a facing corner piece as illustrated in FIG. 12.

The two components of this invention, the facing strip and the work surface-providing sheet, will as noted be adhered directly to each other. Secure adhesion and resistance to separation of the components is provided by use of a recess 28 inset into either the countertop piece 14 itself (as in FIG. 5B) or formed by the underside of an overhang or edge region designated "a" of the countertop 14 and the underlying front edge and/or top surface of a substrate layer or the base 12. Into this recess 28 is fitted a flange or tongue portion 34 which projects rearwardly from the nose portion 32 of the facing 30. This tongue portion 34 is of a width and depth substantially equivalent to the width and depth of the recess 28 in the particular counter system involved, such that when the edging 30 is placed along the front of the counter, the tongue 34 interfits with recess 28 and is secured therein. The edging 30 is normally secured by placing adhesive 25 on tongue 34 such that it is adhesively secured into recess 28 as the system is assembled. Critical to this invention is that at least one surface of each of the countertop material 14 and the tongue portion 34 of the facing 30 abut one another in the recess 28 and thus are directly adhered together by the adhesive 25. In preferred configurations, two, three or more corresponding surfaces abut (see, for instance, FIGS. 2A, 5A and 5B), so that the area of direct adhesion is maximized.

In preferred embodiments of the present invention there will also be present a solid base substrate 16 which is placed on the underlying base 12 between the top of the base and the bottom surface of the countertop sheet 14. Typically this substrate will be a sheet of ½–1 inch (12–25 mm) thick plywood. In most installations the substrate 16 will be hidden from view when the countertop is fully installed, so the plywood may be of a construction grade with little or no surface finishing on either side, except to insure that the substrate is smooth and free of large surface holes which would impair the support of the countertop piece 14. Such sheets of plywood are readily available commercially in many sizes.

Alternatively, wood planks can be substituted for the plywood, such as such as common "1×10" or "1×12" planks, all of which are available in many different lengths.

Figure 6:
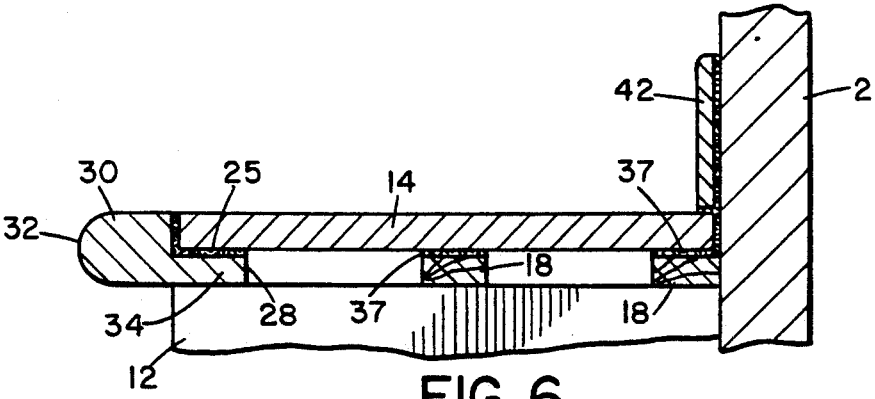
FIG. 6 is a sectional view similar to FIG. 2B, with an alternative substrate structure.

With some types of materials, such as certain synthetic stone materials (the aforementioned "Corian TM" material being one such example), it is recommended by the manufacturers that substantial portions of both the top and bottom surfaces be left exposed, so that the material can "breathe". When such materials are used in the countertop system of the present invention, the substrate 16 is constructed as shown in FIG. 6, being formed of individual spaced apart furring strips 18 laid over the top of the base 12. Thus the required air spaces 20 are left beneath the slab to provide for the recommended free surface exposure.

Figure 7:
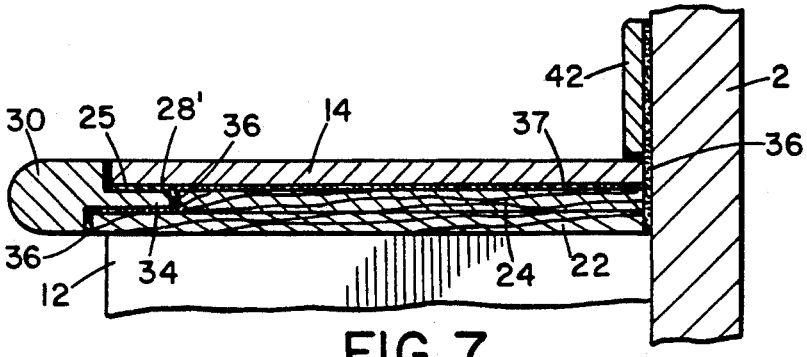
FIG. 7 is a sectional view also similar to FIG. 2B, showing another type of substrate.

In yet another embodiment of the present invention, the base substrate will be composed of two or more adjacent sheets of 22 and 24 of wood as shown in FIG. 7. Such may be useful, for instance, where only thin sheets of substrate material are available so that built-up layers are needed to provide sufficient strength, or where the underside of the counter may be visible (as with a tabletop) and the lower sheet 22 with an attractive outward facing lower surface is desired.

The base substrate 16 (including its embodiments as furring strips 18 and the layered structure 22–24) will be constructed and positioned such that at the forward edge it is overlaid by the countertop 14 which projects outwardly or forwardly past the edge of the substrate 16 so as to form the recess 28 beneath the front edge of the slab 14 and the top of the base 12. In the case of the embodiment shown in FIG. 7 with the plurality of substrate layers 22 and 24 (plus additional layers if desired) the recess (here labeled 28') may be between the bottom of the countertop 14 and the top of the base 12, or as shown, the top of one of the lower layers 22.

The substrate 16 is normally attached to the base 12 in any conventional carpentry manner, such as with nails, screws, adhesives or the equivalent.

It is important in the present invention to accommodate the different coefficients of expansion of the different materials, to prevent cracking or distortion of the work surfaces or separation of the edging 30 from the countertops 14. The various stone materials described above as useful for the countertops 14 and facing 30 all have approximately equal coefficients of expansion, so they can be adhered directly together in a fixed and closely abutting relationship, with no need to compensate for differential expansion. However, the base 12 and substrate 16, which are normally of wood, have coefficients of expansion which are substantially different from the countertop/facing stone materials, and thus provision must be made at the interfaces between the two types of materials to accommodate the differential coefficients of expansion. This may be done in two ways: by use of expansion joints 36 and flexible adhesives 37. The expansion joint may be an air space or a relatively firm but soft material, preferably resilient, which will allow for relative motion between the countertop 14 and substrate 16.

The joints between the various stone pieces will be filled and finished with an adhesive material 25 such as an epoxy, silicone or urethane adhesive. Preferably the adhesive 25 will be a rigid one, so that a firm joint is made. Also preferably, the abutting pieces will be positioned as closely together as possible, with the minimum adhesive layer thickness, so as to eliminate as much as possible to visibility of the joint. The adhesive 25 may be colored and/or contain stone powder filler to further reduce joint visibility. Conversely, the adhesives 37 used to adhere the underside of the countertop 14 or facing 30 to the substrate 16, the expansion material 36 or the base 12 must be flexible adhesives, such as silicones or urethanes, to accommodate the differential coefficients of expansion. (The adhesives used to fill the joints between adjacent stone pieces may also be flexible if desired, but rigid adhesives are preferred to provide a monolithic work surface.)

It will also be desirable in many cases to finish the installation with a backsplash portion 42 which may be of the same material as one or more of the stone materials or may be of a different material. Since the backsplash 42 will not normally receive the same service usage and is less likely be subject to damage, it may alternatively be of a softer material such as a plastic or wood.

The modular nature of the present invention makes it extremely versatile and convenient for the architect, builder and installer. In a typical application, a variety of standard sizes of precut and presurfaced countertop materials, such as granite, synthetic stone-like materials, and ceramics, would be held in inventory by a manufacturer or distributor. It is anticipated that the smallest pieces would be 24×24 inch (60×60 cm) in surface size, in several thicknesses. Larger pieces of various standard thicknesses and surface dimensions would also be stocked. The larger pieces are preferred, since the number of surface joints is thereby minimized. Also stocked would be standard lengths of the preformed edge facings, also in various thicknesses to correspond to the standard countertop thicknesses stocked, along with an inventory of different corner configurations in the different materials, with the curved corner pieces having standard radii, typically 3, 6, 12 or 24 inches (7½, 15, 30 or 60 cm). A builder or installer would simply order those pieces of countertop and edge facing needed for the specific job; irregular or small pieces would be cut from larger ones. Installation would then simply consist of mounting the countertop pieces 14 to the base 12 or substrate 16 with adhesive 37 and simultaneously forming the recess 28. The corner edge facing units **30*b*–30*e* are installed as required by putting adhesive 25 on the tongue 34 and inserting the units into the recess 28 as the appropriate corners. The straight strips 30*a* are cut to length and installed in the same manner by applying adhesive 25 to tongue 34 and fitting it into recess 28. The shorter lengths 30*f*–30*h* are simply cut from longer strips 30*a* as needed. The excess adhesive 25** is removed, leaving a smooth countertop having a continuous appearance with a matching or contrasting edge facing all around. It will be understood, of course, that the actual order of installation will be a matter of choice easily decided upon by the installer skilled in the art. For instance, the corners could be installed after the straight pieces of facing, or one portion of the system could be completed before another is started, and so forth. This procedure represents a marked improvement in ease and speed of installation, as compared to the prior art procedures, which required that edge materials be buttadhered to the edge of countertop and then laboriously cut, sanded and buffed in place afterward.

The edge facing strips are preferably formed in a continuous process in a suitable manufacturing facility. Strips of sufficient width and the desired length are first cut from larger slabs of material and then fed through a series of grinding and cutting wheels which in steps reduce the cross-section of the strip to the desired profile and form the tongue as the strip passes them. The resulting product is an elongated strip having a continuous tongue and the desired front profile. These strips can be inventoried and supplied to users as formed, or they can be cut into shorter lengths and inventoried as pre-cut standard smaller pieces.

It will be evident from the above that there are numerous embodiments of the present invention, which not expressly described, are clearly within the scope and spirit of the invention. The above description is therefore intended to be exemplary only and the scope of the invention is to be limited solely by the independent claims.

I claim:

1. A modular counter structure supported by an underlying base, which comprises:

at least one flat unedged surface-providing sheet member formed of a first material which is essentially impervious to moisture penetration, impact and scratching; said member having a top surface, a bottom surface, a peripheral edge area having in at least a portion thereof a peripheral recess extending upwardly from said bottom surface and terminating below said top surface;

at least one preformed elongated edge facing member formed of a second material which is also essentially impervious to moisture penetration, impact and scratching; said edge facing member having a front and a back; said back comprising a rearward extending tongue portion fitted into said recess and in contact with said sheet member and said base; said front of said edge facing member extending outwardly beyond said peripheral edge area of said sheet member and presenting an appearance which is substantially the same as or consistent with the appearance of said top surface of said sheet member; and adhesive means for directly bonding said sheet member to said edge facing member;

whereby said tongue portion of said edge facing member is retained in said peripheral recess between said sheet member and said base and said sheet member is supported on said base at least in part through said edge facing member.

2. A modular counter structure as in claim 1 comprising a plurality of said edge facing members disposed in linear abutting relation and having interconnecting means between adjacent abutting members.

3. A modular counter structure as in claim 2 wherein at least one of said plurality of edge facing members has a straight configuration.

4. A modular counter structure as in claim 2 wherein at least one of said plurality of edge facing members has a curved configuration.

5. A modular counter structure as in claim 2 wherein said counter structure has at least one corner and at least one of said plurality of edge facing members is configured to conform to said corner.

6. A modular counter structure as in claim 5 wherein said corner is in the form of an angle.

7. A modular counter structure as in claim 5 wherein said edge facing member is in the form of a smooth curve.

8. A modular counter structure as in claim 7 wherein an outer surface of said edge facing member has a radius of 3, 6, 12 or 24 inches (7½, 15, 30 or 60 cm).

9. A modular counter structure as in claim 5 further comprising a fillet in said corner between said edge facing member and said peripheral edge area of said sheet member.

10. A modular counter structure as in claim 1 further comprising said base having a top and there being a substrate disposed between said top and said base and said bottom of said sheet member, said substrate having an outward facing edge.

11. A modular counter structure as in claim 10 wherein at least a portion of said outward facing edge of said substrate forms one surface of said recess.

12. A modular counter structure as in claim 10 wherein said substrate comprises a plurality of layers.

13. A modular counter structure as in claim 1 wherein said recess is formed entirely in said sheet member.

14. A modular counter structure as in claim 1 wherein said first and second materials are each selected from the group consisting of natural stone, synthetic stone-like material, ceramic material, concrete, glass-like material, agglomerated stone material, cement material, metal or terrazzo.

15. A modular counter structure as in claim 14 wherein said first and second materials are each natural stone or synthetic stone-like material.

16. A modular counter structure as in claim 15 wherein said synthetic stone-like material comprises at least one polymeric material.

17. A modular counter structure as in claim 14 where said first and second materials are the same.

18. A modular counter structure as in claim 14 where said first and second materials are different.

19. A modular counter structure as in claim 1 wherein said edge facing member presents a curved visual appearance.

20. A modular counter structure as in claim 1 wherein said edge facing member presents a straight visual appearance.

* * * * *

UNITED STATES PATENT AND TRADEMARK OFFICE

CERTIFICATE OF CORRECTION

PATENT NO. : 5,253,932
DATED : OCTOBER 19, 1993
INVENTOR(S) : DANILO N. NESOVIC

It is certified that error appears in the above-indentified patent and that said Letters Patent is hereby corrected as shown below:

COLUMN 10, CLAIM 10, LINE 25, AFTER "TOP" DELETE "AND" AND INSERT --OF--.

Signed and Sealed this

Twenty-sixth Day of April, 1994

*Attest:*

*Attesting Officer*

BRUCE LEHMAN

*Commissioner of Patents and Trademarks*